United States Patent [19]

Rut

[11] 4,272,979

[45] Jun. 16, 1981

[54] METHOD AND APPARATUS FOR FORGING CRANK THROWS

[75] Inventor: Tadeusz Rut, Poznan, Poland

[73] Assignee: Instytut Obrobki Plastycznej, Poznan, Poland

[21] Appl. No.: 2,777

[22] Filed: Jan. 11, 1979

[30] Foreign Application Priority Data

Jan. 14, 1978 [PL] Poland ..... 204016
Nov. 22, 1978 [PL] Poland ..... 211132

[51] Int. Cl.[3] ..... B21K 1/08

[52] U.S. Cl. ..... 72/356; 29/6; 72/403

[58] Field of Search ..... 72/354, 399, 402, 356, 72/403; 29/6; 74/595, 596, 597, 598

[56] References Cited

U.S. PATENT DOCUMENTS

| | | | |
|---|---|---|---|
| 2,827,685 | 3/1958 | Cleghorn | 29/6 |
| 3,129,488 | 4/1964 | Robra | 29/6 |
| 3,348,407 | 10/1967 | Rut | 72/450 |
| 3,867,832 | 2/1975 | Rut | 72/399 |
| 4,041,755 | 8/1977 | Rut | 29/6 |

FOREIGN PATENT DOCUMENTS

| | | | |
|---|---|---|---|
| 1166199 | 6/1957 | France | 29/6 |
| 1166978 | 6/1958 | France | 29/6 |
| 323183 | 3/1972 | U.S.S.R. | 29/6 |

*Primary Examiner*—Ervin M. Combs
*Assistant Examiner*—Gene P. Crosby
*Attorney, Agent, or Firm*—Ladas & Parry

[57] ABSTRACT

A method and an apparatus for forging crank throws comprising upsetting a portion of a bar and directing the flowing material to form a preformed part having at the ends of the upset portion two upsets (27*a*) situated eccentrically to the axis of the bar. To form the ready forging a bending force is applied against the central portion of the preformed part, between the two eccentrical upsets (27*a*). The bending force is perpendicular to the upsetting force and is opposite to the crests of the eccentrical upsets. During forging operation the bar is fastened between segment dies (20,21) mounted in upper and lower die holders (7,18). The lower die holders (7) are supported by artitulated links (5,11) pivotably mounted to a fixed base. On this base a bending tool (23) is mounted. The upper die holders are slidably mounted to a head, which is fixed to a press ram. To the head an anvil (25) is fastened. This anvil has two working faces, which are interchangeable during the crank throw forging process.

12 Claims, 24 Drawing Figures

METHOD AND APPARATUS FOR FORGING CRANK THROWS

This invention relates to a method for forging crank throws and a forging device destined for the manufacturing of crank throws, especially crankshafts and similarly shaped products.

A prior art method for shaping crank throws consists in bilateral upsetting of a bar portion and simultaneously bending of its middle part. With this known method it is impossible to form crank throws having prominent projections at the crank arms on the side of crankshaft's main bearing journals. Projections like these have been obtained by turning these parts of a blank, which are destined to be the crankshaft's main bearing journals and the crank pins in the finished product. Such a turning increases the production costs and causes material losses. Moreover, on the turned places the fibres of the metal are cut, and that has a negative effect on the mechanical properties of the ready forging. Among the devices for forging crankshafts in the presses by upsetting and bending methods, there are known such as these, where the movement of a press ram is converted, through articulated links into a transverse movement of the upsetting dies. The first ends of these links are pivotably coupled to a head combined with the press ram, and the second ends are pivotably coupled to upsetting die holders above their pitch plane.

A device of the above mentioned type is known, for example, from the U.S. Pat. No. 3,348,407. In this device the lower ends of the articulated links are pivoted in the upper upsetting dies, above their parting plane. These links have almost the same width as the dies.

Such a design is sometimes disadvantageous, because the lower ends of the links are pivoted only on the one side of the parting plane of the die set. A moment of a couple of forces arises therefore, while the device works. This causes an irregular load of the respective links. As a result of that the dies tend to "overturn". It is also known that in such devices the quantity of the available upsetting force rises together with the increase of the link inclination angle. However, together with the increase of the link inclination angle, the difference between loads carried by the respective links also rises. Thus the value of the above mentioned moment of a couple of forces, causing the "dies overturn", rises too.

Moreover, in the device according to the U.S. Pat. No. 3,348,407, the upper ends of the articulated links abut only on the lower surface of the head mounted on the press ram, which in turn causes its unaxial tension during the operation. Therefore the bending moment rises. It is very disadvantageous for the structural strength. In the devices of such type, the bending of the upset bar could have been performed only in one direction.

An object of the invention is to provide a method for forging crank throws, having prominent projections at the crank-webs on the side of the crankshaft's main bearing journals.

According to the invention, during the upsetting, before the bending of the middle part of the upset portion, the flowing material is directed to form at the ends of the upset portion two upsets, which are situated eccentrically to the axis of the bar and whose crests are directed opposite to the intended bending direction.

The shaping of the said eccentric upsets makes it possible to form in the subsequent forging steps prominent projections at the crankwebs on the side of the crankshaft's main bearing journals. These prominent projections are themselves counterweights, or counterweights are fastened to them. In the finished forging the fibres of the metal are perfectly oriented.

The step in which the flowing material is directed to form eccentric upsets on the bar can be performed by one of the following methods:

According to one of these methods the two eccentrical upsets are shaped during the upsetting step by dislocating the middle part of the upset portion opposite to the intended bending direction, and forcing the central part of the upset material in the same direction through a fork shaped sizing pass to narrow its cross section.

According to one particular embodiment of the above mentioned method, the material being forced through the fork shaped sizing pass is during the dislocating or upsetting step and after it squeezed perpendicularly to the axis of the bar, so that a part of it flows out of the sizing pass.

According to another method for the shaping of the two eccentrical upsets on the bar, they are formed during the upsetting step by putting towards one side of the upset portion an element which limits the flow of material and whose limiting surface lies in the generating line of the bar's cylindrical surface, and by forcing its central part at the opposite side of the upset portion through a fork shaped sizing pass to narrow its cross section.

In the method for forging crank throws, according to the invention, the sizing of the throws can be performed either in one forging step or by manufacturing first a preformed part out of the raw bar. This performed part is shaped like a bar, and on each portion of it, destined for shaping a throw, at one side of the bar's cylindrical surface there are two upsets situated eccentrically to the axis of the bar. Then, in a second step, one or more crank throws are forged on this preformed part.

Therefore an object of the invention is also the size of the above mentioned preformed part. It is shaped like a bar, which, on each portion destined for shaping a throw, is at one side of the bar's cylindrical surface provided with two upsets, situated eccentrically to the axle of the bar. The said upsets lie in certain distance of each other. The opposite side of the bar's surface is either saddle-shaped or the generating line of this surface is substantially a straight line.

Similar to other known designs, the device is provided with two sets of segment dies situated in die holders between a head and a base, applied for fastening the forged material and upsetting it by the movement of these die sets towards one another in the direction perpendicular to the press ram movement. In the upsetting zone between the faces of the both segment die sets, there are a bending tool operatively associated to the base and an anvil operatively associated to the head, destined for forming a crank pin from the upset material. The die holders, situated on the one side of the die pitch plane, are pivotably coupled to the first ends of obliquely positioned articulated links whose second ends are pivotably coupled to the base. The said die holders are coupled by means of drivers with die holders slidably mounted to the head and situated on the other side of the die pitch plane.

According to the invention the anvil of this device is provided with two working faces being interchangeable during the crank throw forging process.

It is evident that on the surface of the preformed part some little unevenness, such as flashes, may be formed. These unevenness are insignificant for the transformation of the preformed part to a finished crankshaft.

The method according to the invention may be embodied in various known devices after some adaptation of their equipment or tools. Thus, for example, this method can be applied using the device, known from the U.S. Pat. No. 3,348,407 after adequate modification of its, bending tool and anvil.

An object of the present invention is a device especially suitable for carrying out the above said method.

It is advantageous if the two interchangeable working surfaces of the anvil are obtained by coupling to it a preliminary anvil. The preliminary anvil is removably fastened to the anvil.

In case the preformed part is shaped by joggling the middle part of the upset portion, it is advantageous to provide the device with oblique guides, positioned convergently to the anvil. On these guides those die holders are guided which are coupled by means of drivers to the die holders articulated on links.

A puller, mounted in the forging device, facilitates the shaping and taking out of the ready forging. This puller embraces the bending tool from both sides. The puller is provided with die cavities, which shape the crankwebs on the side of the main bearing journals.

In another embodiment of the device, the pulling out of the ready forging is facilitated by the following elements: the bending tool abuts on displaceable brackets, and beside the anvil pushrods are mounted. The said pushrods can be pushed out towards the bending tool.

Unfavourable stresses in the device structure can be avoided if the inner articulated links, situated nearer to the upsetting zone, have their lower bearing members abutted against projections in the lower part of the beam in the form of the letter H, which composes the device base. The upper bearing members of these inner links are located in the lower die holder below the die pitch plane. The extreme articulated links, located farer from the upsetting zone, have the lower bearing members abutted against projections in the upper part of the said beam, composing the base, and the upper bearing members of these extreme links are situated in the lower die holder above the die pitch plane. As a result of such a design, the base beam is not subjected to bending, but only to tensile forces, and any moment of a couple of forces causing the "overturn" does not act on the die holders. The forces acting on the links are pretty much evenly distributed.

In the device according to the invention, the inner articulated links have a U-like shape and their arms enclose the lower die holder from both sides.

The use of the U-shaped link, instead of the uniform one, applied in the design according to the U.S. Pat. No. 3,348,407, makes it possible to bring the pivoted point closer to the die pitch plane. This is especially profitable in the case of device, for forging of crankshafts, for two reasons: it is possible to minimize the device's height and to load evenly the links.

The method according to the invention and the equipment, as well as the preformed parts used therein, will be discussed in detail with reference to the annexed drawing which shows examples of the invention not limiting its range.

In the drawings

Figure 1:
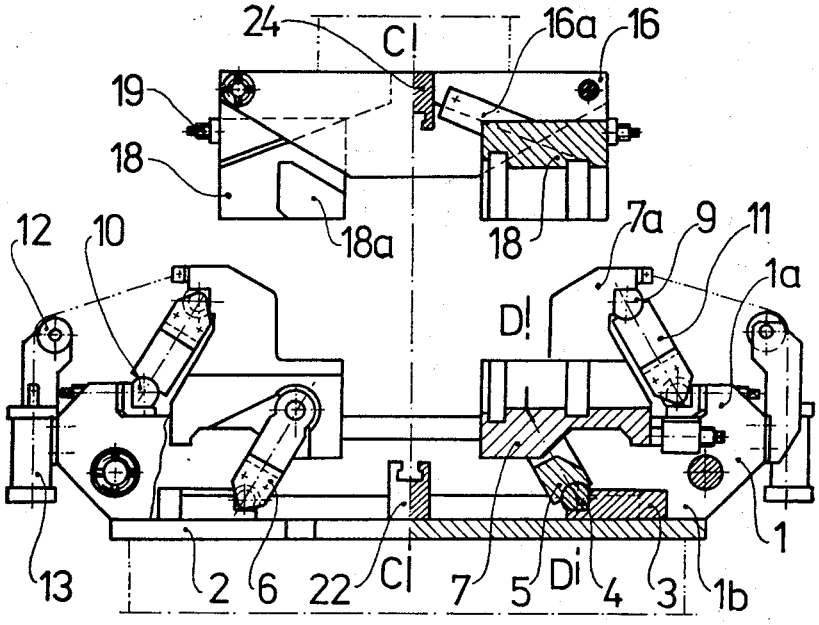
FIG. 1 shows an open device without tool inserts in a side view, partly in a section.
Figure 2:
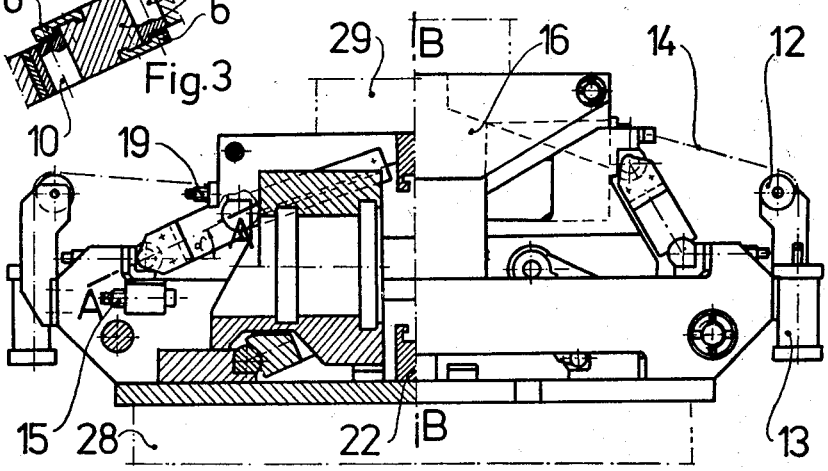
FIG. 2 shows the closed device at the end of a working stroke in a side view, partly in a section.
Figure 4:
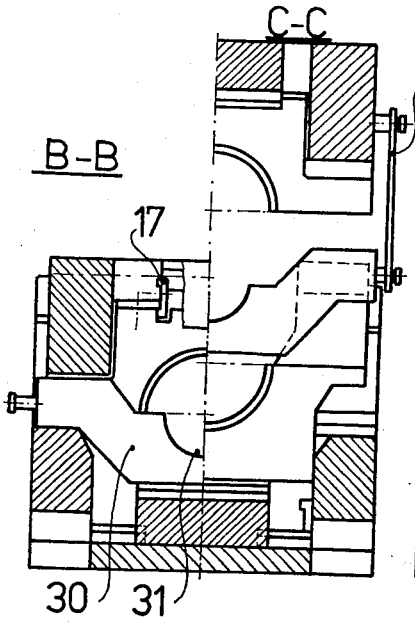
FIG. 4 shows the same device in section, where the left part of the drawing shows a section along the line B—B of FIG. 2, and the right side a section along the line C—C of FIG. 1, respectively.

The device according to the invention, shown in FIGS. 1–2, consists of two assemblies: i.e. lower and upper.

Figure 3:
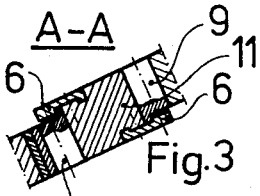
FIG. 3 shows a section along the line A—A of FIG. 2.
Figure 5:
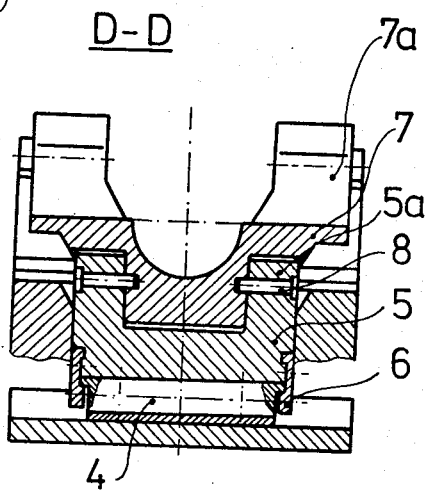
FIG. 5 shows a section along the line D—D of FIG. 1.
Figure 6:
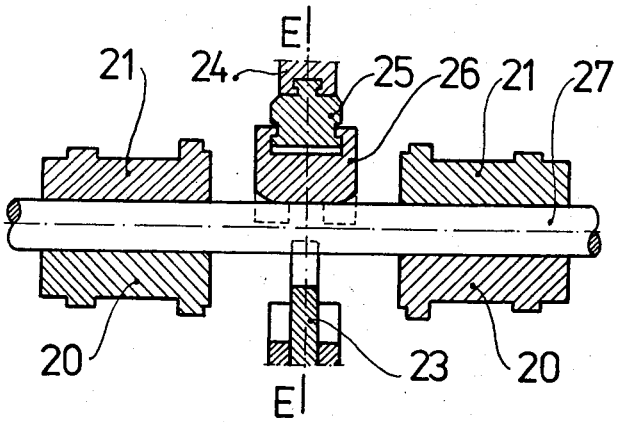
FIGS. 6–9 show tool inserts used in the device of FIGS. 1 and 2 and the shaped material in four consecutive phases of crank throw shaping, in axial section.
Figure 7:
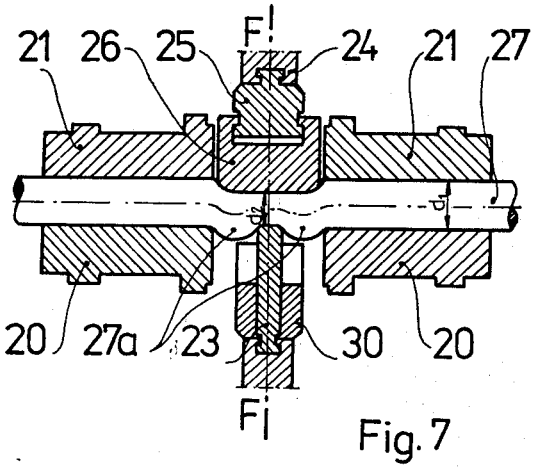
Figure 8:
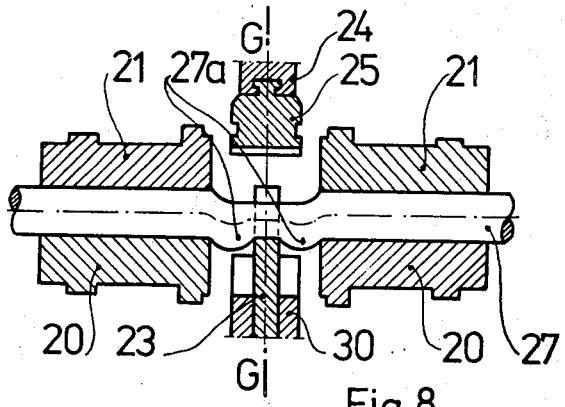
Figure 9:
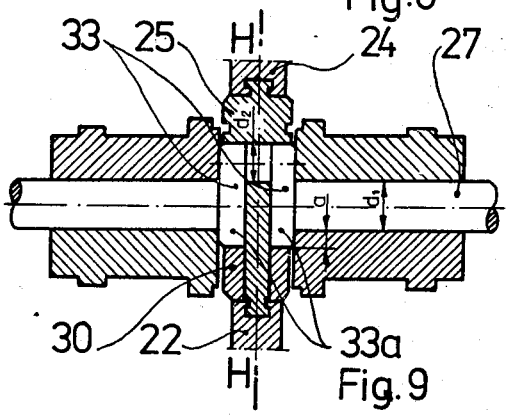
Figure 10:
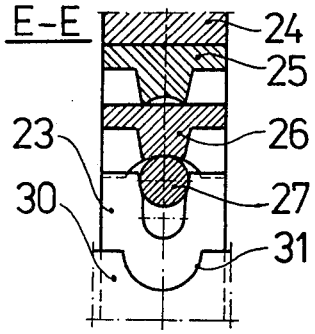
FIGS. 10–13 show the same inserts and forged material in section along the line E—E, F—F, G—G, H—H of FIGS. 6–9, respectively.
Figure 11:
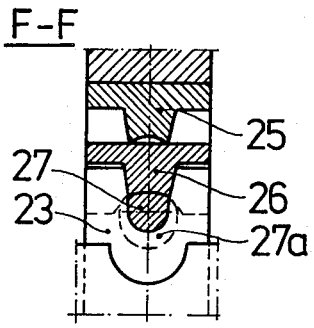
Figure 12:
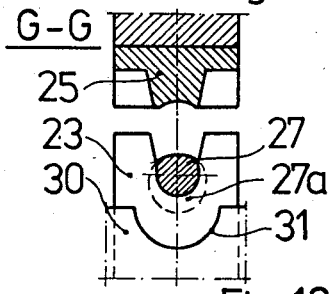
Figure 13:
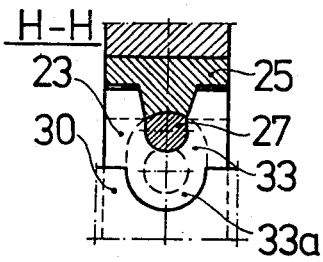
Figure 14:
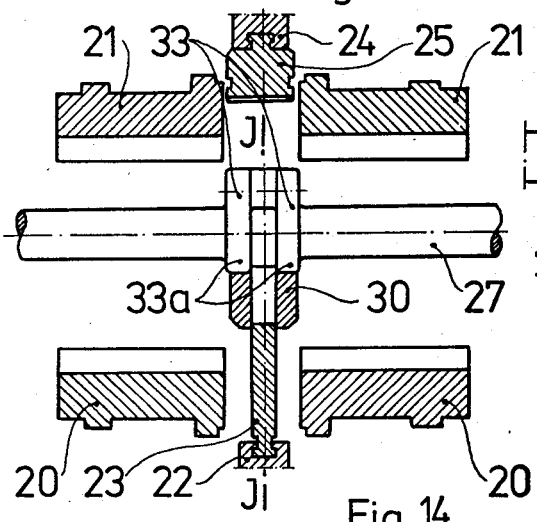
FIG. 14 shows the tool inserts together with the formed crank throw after its lifting out of dies by means of a puller, in lengthwise section.
Figure 15:
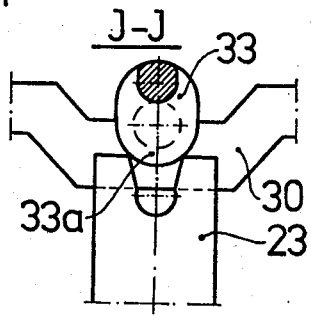
FIG. 15 shows the same inserts with the crank throw in a section along the line J—J of FIG. 14.

The lower assembly has at the base two longitudinal beams 1, interconnected by spacing bolts. The beams rest on the plate 2. Each of the beams 1 has two projections 1*a* in the upper part, and two projections 1*b* in the lower part. Two transverse beams 3 abut against the lower projections 1*b*. A bearing member 4 is fastened to each beam 3. Against the bearing member 4, an articulated U-shaped link 5 abuts. This link is shown in FIG. 5. The lower bearing part of this link is concave, whereas the upper bearing part has two arms 5*a* which are convex-shaped. The link 5 is secured by means of two connecting links 6 (FIG. 3), against a flange of the member 4.

The connecting links 6 have the shape of straps with projections engage recesses made in the link 5 and in the member 4. A lower die holder 7 rests on the upper arms 5*a* of the articulated link (FIG. 5). The holder face which abuts against the link 5 is under the die pitch plane. A mandrel 8 (FIG. 5) secures the holder 7 against a detachment of the link 5. A bearing member 9 is fastened to the lower die holder 7 above the die pitch plane. A similar bearing member 10 is abutted on the upper face of the beam 1 and its upper projection 1*a*. Between the bearing members 9 and 10, there is situated an articulated link 11. Thus, in the device of FIGS. 1 and 2 each lower die holder 7 is guided by two articulated links 11 and one U-shaped link 5, composing together with them and the beams 1, a parallelogram-shaped mechanism. Hydraulic servos 13, connected through tie lines which are, wound around rollers 12, with the die holders 7, are mounted on the ends of the beams 1. They serve to return the die holders 7 to their initial position, until they abut against the stops 15.

The upper device assembly consists of two head beams 16 which are interconnected by means of spacing bolts. The beams 16 are provided with long oblique slide guides 16*a*, to which the upper die holders 18 are slidably mounted by means of strips 17. These holders abut in their initial position against the stops 19. The upper die holders 18 are provided with projections 18*a* performing a function of drivers, which during the working stroke abut on the projections 7*a* of the lower die holder. Thus a coupling of the holders 7 and 18 of die halves is achieved.

In the device shown in FIGS. 1 and 2 forging tools are mounted. An exemplary set of these tools is shown in FIGS. 6–13.

Die inserts 20 are fastened in the lower die holders 7 and inserts 21 in the upper holders 18, respectively. A bending tool 23 is fastened to a holder 22 which in its turn is fastened to the plate 2. An anvil 25 together with a preliminary anvil 26 are fastened to the holder 24, mounted on the head beams 16. In case of forging of multithrow-crankshafts besides the above-mentioned tools, inserts are applied, which are not shown in the drawing. The last mentioned inserts serve to establish a proper angle of the crank throw twist in relation to the adjacent ones.

The device is mounted in a press and operates as follows: A hot blank 27 is introduced into the opened device shown in FIG. 1, and deposited on the lower die inserts 20, and then the press is set in motion. In the drawing, the press table is designated by number 28 and the press ram by 29, respectively. During the working stroke of the press, the upper die holders 18 pressed on the lower die holders 7.

As the articulated links 5 and 11 are disposed at an acute angle with respect to the horizontal, and approach the horizontal at the end of the working stroke, a horizontal movement of the right and left dies towards each other takes place, which causes upsetting of the bar portion, placed between them. Because of the oblique guides 16*a*, applied for the die holders 18, the preliminary anvil 26 approaches during the working stroke, the axis of the shaped material 27, causing its dislocation downwards, in the direction to the bending tool 23. The middle portion of the upset material is forced through the fork shaped sizing pass made in the bending tool 23. The sizing pass is narrows downwardly and its lower part has the width smaller than the diameter of the shaped blank. During this forcing step and after the complete filling of the sizing pass, the material is the vertical direction. This vertical squeezing reduces the vertical cross-section of this material. The material is partly extruded from the sizing pass and forms, together with the upset material, the eccentrical upsets 27*a* on both sides of the bending tool. Thus a preformed part for the manufacturing of a crankshaft is formed. Now the working stroke of the press is interrupted. The press ram is slightly lifted and the preliminary anvil 26 is removed. Then the press is restarted. During this continued working stroke of the press the bending tool 23 bends the preformed part opposite to the first direction of dislocation, made previously by the preliminary anvil 26. The forgoing operation ends when the lower die holders 7 rest on the beam 1. The prominent projections 33*a* protruding out of the profile of the main bearing journals on the opposite side to the crank throw, have been formed out of the eccentric upsets 27*a*.

The lifting of the forged crankshaft out of the bending tool's sizing pass takes place during the return upward movement of the press ram 29 by means of a puller 30. This puller, which embraces from two sides the bending tool 23 has in its middle portion a recess 31, used for shaping the parts of the crank throw arms on the side of bearing journals. The puller 30 is connected to the head beams 16 by means of tie arms 32.

Figure 16:
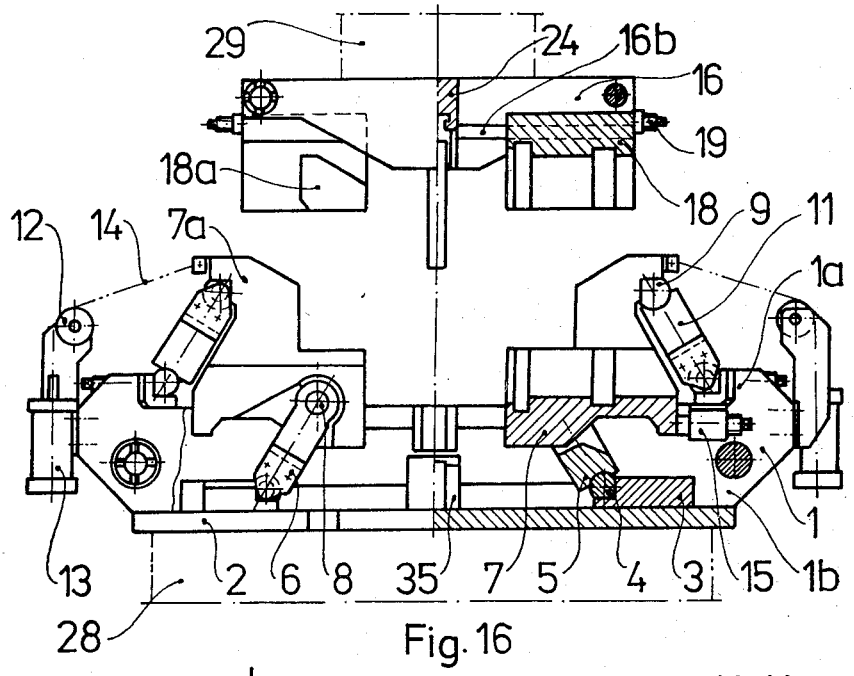
FIG. 16 shows another embodiment of the device in a side view, partly in a section.
Figure 23:
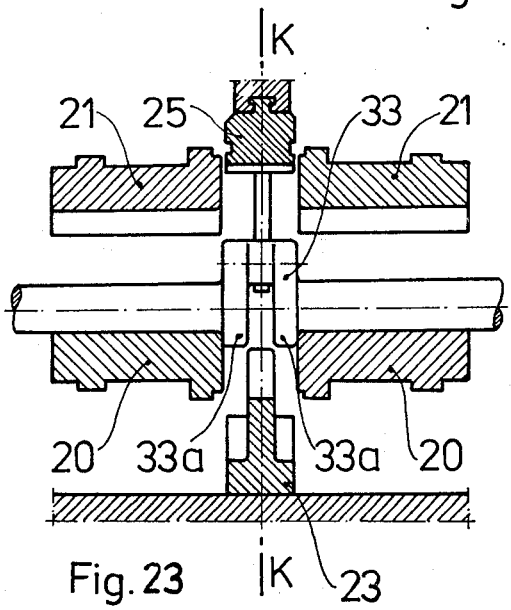
FIG. 23 shows the ready crankshaft and the forging tools after lifting out the bending tool.
Figure 24:
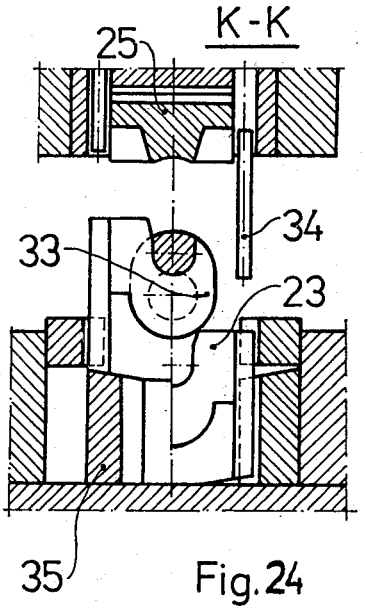
FIG. 24 shows the ready crankshaft and the forging tools in section along the line K—K of FIG. 23; the left half of the drawing shows the tools in their upper position, while the right half of the drawing illustrates these tools in their lowest position.
Figure 17:
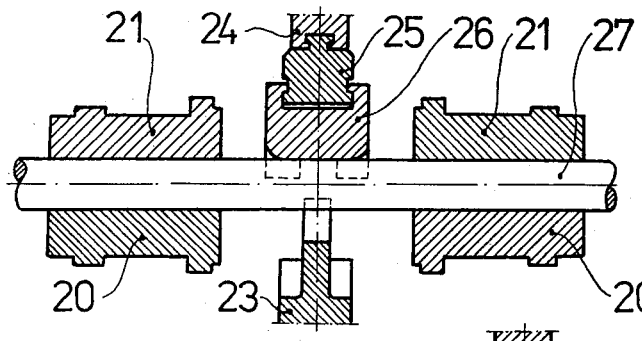
FIGS. 17–20 show tool inserts used in the device of FIG. 16 and the forged material in four consecutive phases of crank throw shaping, in an axial section.
Figure 18:
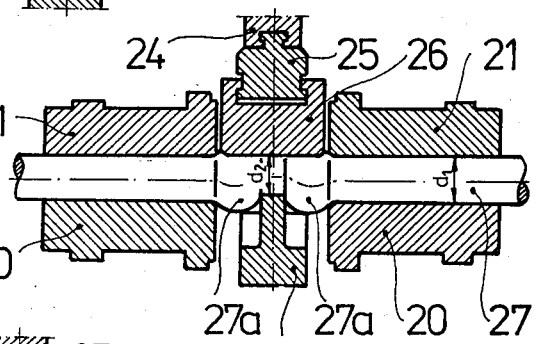
Figure 19:
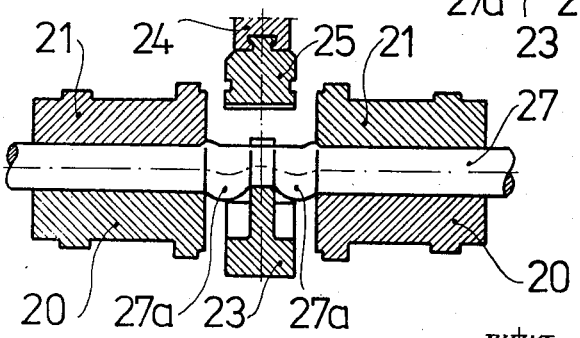

In the embodiment of the device shown in FIG. 16, the lower assembly of the device has a construction generally like the device according to FIG. 1, with the difference, that the bending tool abuts on displaceable brackets. The upper assembly has a different design. Instead of the oblique slide guides 16*a*, horizontal guides 16*b* for the die holders 18 are provided. The anvil holder 24, the anvil 25 and the preliminary anvil 26 are mounted in the device similarly as shown in FIGS. 1–3 and FIGS. 6–13. By such a design, the height of the upper assembly and therefore the height of the whole device, is smaller.

After the removing of the anvil, the preliminary anvil and the bending tool, such a device can be used for upsetting only.

Figure 21:
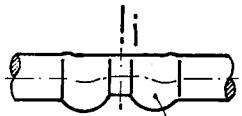
FIG. 21 shows the preforged part in side view.
Figure 22:
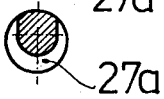
FIG. 22 shows the preformed part in a section along the line i—i of FIG. 21.
Figure 20:
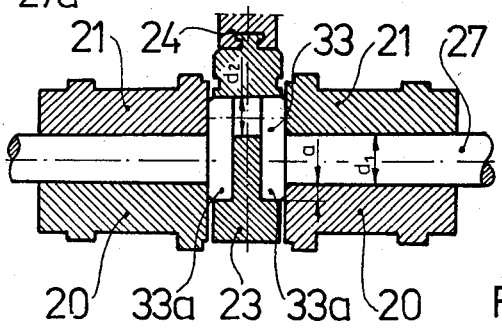

The embodiment of the device shown in FIG. 16 operates as follows: Into the open device provided with tools shown in FIGS. 17–20, a hot blank 27 is introduced and deposited on the lower die inserts, and then the press is set in motion. In the drawing the press table is designated by number 28 and the press ram by 29 respectively. During the working stroke of the press the upper die holders 18 press on the lower press holders 7. Since the articulated links 5 and 11 are disposed at an acute angle with respect to the horizontal, and approach the horizontal at the end of the working stroke, a horizontal movement of the right and left dies towards each other takes place. This causes the upsetting of the bar portion placed between them. During this upsetting step the preliminary anvil 16 limits the flow of the material upwards, and therefore the bar's surface remains on this side cylindrical, which means not disclocated. Only on the sides of the preliminary anvil small flashes are formed which are unsignificant for the following forging steps. The upset material is directed downwards and to the sides. During the working stroke the forged bar approaches the bending tool 23 because of the deflection of the articulated links. The central part of the upset portion of this bar is forced into the fork shaped sizing pass of the bending tool. This forcing step causes a narrowing of the said central part. The material is partly extruded from the sizing pass and forms, together with the upset material, the eccentrical upsets 27*a* on both sides of the bending tool. Thus a preformed part for the manufacturing of a crankshaft is formed. This preformed part is shown in FIG. 21 and 22 of the drawing. Now the working stroke of the press is interrupted, the press punch is slightly lifted and the preliminary anvil 26 is removed. Then the press is restarted. During this continued working stroke of the press the bending tool 23 bends the preformed part opposite to the crests of both eccentrical upsets 27*a*. The forging operation ends when the lower die holders 7 rest on beam 2. The prominent projections 33*a*, protruding out of the profile of the main bearing journals on the opposite side to the crank throw, are formed from the eccentric upsets 27*a*.

The lifting of the forged crankshaft out of the bending tool's sizing pass takes place during an additional working stroke of the press. Therefore in the upper assembly of the device, pushrods 34 are provided, which can be pushed out and locked in their lower position by a lock, not shown in the drawing. After the opening of the press these pushrods are pushed out downwards and locked, the brackets 35 are displaced to the sides and the press is restarted. The pushrods 34 press on the upper surface of the bending tool 23 and push it downwards. After the opening of the press the ready forging can be taken out of the dies 20.

The shaping of the crankshafts cannot be performed only in the above mentioned way.

It is also possible to manufacture first, in a separate device, the preformed part. The shaping of this part ends perhaps at the moment shown in FIG. 7 and 18 of the drawing. This preformed part is a semi-finished product, that can be at any time forged to a ready crankshaft.

The drawing shows the foregoing of the simplest crankshafts with only one throw. Obviously, according to the invention it is possible to forge multithrow crankshafts. In such a case, on each portion of the bar, destined for shaping a throw, two eccentrical upsets are provided. These upsets are oriented according to the orientation of the throws in the ready crankshaft.

What I claim is:

1. A method of forging crank throws in which a portion of a bar is upset by applying opposed longitudinal forces on the said portion and its middle part is bent in a direction which is perpendicular to the direction of the upsetting forces, wherein during the upsetting step, before the bending of the middle part, the flowing material is directed to form at the ends of the upset portion two upset projections which are situated eccentrically to the axis of the bar and which include crests which are directed opposite to the intended bending direction of said middle part.

2. A method as claimed in claim 1, wherein the upset projections are shaped during the upsetting step by dislocating the middle part of the upset portion opposite to the intended bending direction, and forcing the central part of the upset material in the same direction through a fork shaped sizing pass to narrow its lateral cross section.

3. A method as claimed in claim 2, wherein during and after the dislocating step the material being forced through the fork shaped sizing pass is squeezed perpendicularly to the axis of the bar, so that a part of it flows out of the sizing pass.

4. A method as claimed in claim 1 wherein the upset projections are shaped during the upsetting step by restraining one side of the upset portion with an element which limits the flow of material and whose limiting surface lies at least in part along and axially tangent to the cylindrical surface of the bar, and by forcing its central part at the opposite side of the upset portion through a fork shaped sizing pass to narrow its cross section.

5. Apparatus for forging crank throws from an elongated cylindrical workpiece, comprising a press ram mounted for reciprocal movement, two sets of opposing segment dies fastened to upper and lower die holders and mounted respectively on an upper head member and transverse beam means, means for moving said dies toward each other for gripping said cylindrical workpiece to be forged by upsetting said workpiece in a zone between the faces of both sets of segment dies by the movement of said die sets toward each other in a direction transverse to the direction of press ram movement, a bending tool and a cooperating anvil means mounted for reciprocal movement perpendicular to the axis of said workpiece in said zone between the faces of both segment die sets, and adapted to form an offset crank pin from the upset material, each of the lower die holders being pivotably connected by means of bearing members to the upper ends of a pair of articulated links, which links are angularly disposed with respect to the axis of said workpiece, said links having lower ends pivotably connected by means of bearing members to said transverse beam means mounted on a base, said lower die holders being coupled by means of driver members with said upper die holders, said upper die holders being slidably mounted in laterally disposed guide means secured to said upper head member, said anvil means having two effective working face means adapted for interchangeable engagement with said workpiece during said crank throw forming process.

6. Apparatus as claimed in claim 5, including a preliminary anvil removably fastened to the anvil.

7. Apparatus as claimed in claim 5, including a pair of oblique slide guides positioned convergently to the anvil on which the upper die holders are guided.

8. Apparatus as claimed in claim 5, including a puller which embraces the bending tool from both sides, and which is provided with die cavities which shape one side of the crankwebs.

9. Apparatus as claimed in claim 5, wherein said bending tool is mounted on displaceable brackets and vertical pushrods are mounted beside the anvil, each said pushrod adapted to be extended to engage said bending tool.

10. Apparatus as claimed in claim 5, wherein bearing members connected to the lower ends of inner articulated links situated nearer to the upsetting zone are fastened to the lower part of said beam means, bearing members for the upper ends of said inner links which abut the lower die holders below the horizontal parting plane of the segment dies, said bearing members connected to the lower ends of extreme articulated links being situated farther from the upsetting zone and which abut against projections formed on the upper part of the beam means, and said bearing members connected to the upper ends of the extreme articulated links abut against projections on the lower die holders above the parting plane of the segment dies.

11. Apparatus as claimed in claim 10, wherein the articulated links connected between the lower die holders and said beam means are U-shaped, and their arms enclose the lower die holder from both sides.

12. Apparatus for forging crank throws in a press comprising a press ram, two sets of segment dies fastened to upper and lower die holders and situated between an upper head and a lower base and are applied for gripping the forged material and upsetting in a zone between the faces of both segment die sets by the movement of said die sets toward each other in a direction transverse to the press ram movement, each of the lower die holders being pivotably connected by means of bearing members with the upper ends of articulated links, the lower ends of said articulated links being pivotably connected by means of bearing members with fixed beam means forming a base of the apparatus, said lower die holders being coupled by means of drivers with the upper die holders, which are slidably mounted on slide guides situated on the upper head, the bearing members of the lower ends of inner articulated links being situated nearer to the upsetting zone and fastened to the lower part of said fixed beam means, the bearing members of the upper ends of said inner links abutting the lower die holders below the parting plane of the segment dies, the bearing members of the lower ends of extreme links being situated farther from the upsetting zone abut against projections on the upper part of said beam means, and the bearing members of the upper ends of the extreme links abut against projections on the lower die holders above the parting plane of the segment dies.

* * * * *